US011650024B2

(12) United States Patent
Zuo

(10) Patent No.: US 11,650,024 B2
(45) Date of Patent: May 16, 2023

(54) COLOR BAR LAUNCHER

(71) Applicant: Liang Zuo, Hunan (CN)

(72) Inventor: Liang Zuo, Hunan (CN)

(73) Assignee: Liuyang Yuebanwan Arts and Crafts Manufacturing Co., Ltd., Hunan (CN)

( * ) Notice: Subject to any disclaimer, the term of this patent is extended or adjusted under 35 U.S.C. 154(b) by 0 days.

(21) Appl. No.: 17/555,377

(22) Filed: Dec. 18, 2021

(65) Prior Publication Data

US 2022/0244014 A1 Aug. 4, 2022

(30) Foreign Application Priority Data

Jan. 29, 2021 (CN) ..... 202120255312.2

(51) Int. Cl.
*A63H 37/00* (2006.01)
*F41B 7/00* (2006.01)
*F41B 7/08* (2006.01)

(52) U.S. Cl.
CPC ..... *F41B 7/08* (2013.01); *A63H 37/00* (2013.01); *F41B 7/00* (2013.01)

(58) Field of Classification Search
CPC ..... A63H 37/00; F41B 7/00
See application file for complete search history.

(56) References Cited

U.S. PATENT DOCUMENTS

| | | | | |
|---|---|---|---|---|
| 5,338,242 | A * | 8/1994 | Cheng | A63H 37/00 446/183 |
| 6,572,435 | B1 * | 6/2003 | Wong | A63H 37/00 124/16 |
| 8,876,574 | B2 * | 11/2014 | Bourdelaise | A63H 37/00 446/475 |
| 9,636,603 | B2 * | 5/2017 | Wang | F41B 11/66 |
| 10,603,601 | B2 * | 3/2020 | Wang | A63H 37/005 |
| 2018/0164083 | A1 * | 6/2018 | Okamura | A63H 37/00 |

* cited by examiner

*Primary Examiner* — John A Ricci

(57) ABSTRACT

The present invention discloses a color bar launcher, which comprises a cylinder for holding color bars and an elastic sleeve; Two ends of the cylinder are open, one end is connected with an end cover, and the other end is closed by the elastic sleeve; the middle part of the outer side of the elastic sleeve is provided with a hand pinching part; the surface of the end cover is provided with a launching port, a positioning ring is fixed around the launching port, protrusions are arranged inside the positioning ring, and a sealing sheet that closes the launching port is movably assembled between the positioning ring and the protrusions. It can ensure the successful launch of the color bar; at the same time, it has the advantages of simple structure, convenient assembly and low cost.

8 Claims, 3 Drawing Sheets

COLOR BAR LAUNCHER

FIELD OF THE DISCLOSURE

This application relates to a toy that emits color bars.

BACKGROUND

The Chinese application patent document with the authorized announcement number CN 209069115 U discloses "a kind of firework tube": it includes a tube with openings at both ends, the tube is used to fill and release the fireworks, and one end of the tube is provided with an elastic pushing part, the elastic pushing part provides a pushing force to the firework in the cylinder to release the firework, the elastic pushing part includes a fixing plate, a spring, and a spring release pin, and the fixing plate is fixedly connected to the cylinder. One end of the spring is fixed on the fixing plate, and the other end is abutted against the spring release pin. Along the radial direction of the cylinder, the spring release pin is slidably arranged on the cylinder, And the spring is arranged between the fixed plate and the spring release pin in a compressed state.

Although the prior art solves the potential safety hazards of gunpowder launching, its drawbacks are complex structure and difficulty in assembly, which greatly increases production costs. However, as a one-time-use toy product, the color bar launcher cannot afford higher prices in the market.

SUMMARY OF THE INVENTION

In order to solve the above drawbacks, the technical problem to be solved by the present application is to provide a color bar launcher with a simple structure. In order to solve the above technical problems, the technical solution adopted by the present application is a color bar launcher, which is characterized in that it comprises a cylinder body for holding color bars and an elastic sleeve; two ports of the cylinder are open, and one end is connected to an end cover. The other end is closed by an elastic sleeve; the middle part of the outer side of the elastic sleeve is provided with a hand pinch part; the cover surface of the end cap is provided with a launching port, a positioning ring is fixed around the launching port, and a card body is provided on the inner side of the positioning ring to close the launching port. The sealing sheet is movably assembled between the positioning ring and the fixing body.

In the above technical solution, the elastic sleeve is composed of a similar elastic fabric such as rubber skin or plastic skin. The sealing sheet is a cardboard sheet or similar materials. When in use, the launching port faces the launching direction, and the pinching part of the elastic sleeve is pulled outwards and then released. The elastic sleeve rebounds and drives the air in the cylinder to impact the sealing plate, so that the movably assembled sealing plate separates from the positioning ring and the fixing body. The restraint of the body rushes out from the launch port to release the closure of the launch port; at the same time, the inner side of the elastic sleeve directly touches the color bar, and directly drives the color bar to eject when it rebounds, and the color bar is launched from the opening side, with the assistance of the air in the tube Launched into the air.

The hand-pinching portion could be a lace, a pull ring, etc., that can attached to the elastic sleeve, which is convenient to pinch the elastic sleeve by hand and pull it outward and then release it. Preferably, the handle portion is a protrusion on the body of the elastic sleeve. After pulling outwards and then releasing, the protrusion rebound can increase the impact force formed by the rebound. For ease of assembly, preferably, the elastic sleeve includes an integrally formed sleeve portion, a cover portion and a protrusion. The sleeve portion wraps and connects the outer side wall of the cylinder. The protrusion is in the middle position of the cover part.

In order to further increase the strength of rebound impact. Further, the protruding portion is a hollow body, and the middle cavity of the hollow body communicates with the inner cavity of the cylinder body. Further, the thicknesses of the socket part, the cover part and the protrusion part increase in order. Further, the thickness of the socket part is 0.8-1.5 mm, the thickness of the cover part is 1.6-2.2 mm, and the thickness of the protruding part is 2.5-4.5 mm. Preferably, the thickness of the socket part is 1.1 mm, the thickness of the cover part is 1.8 mm, and the thickness of the protrusion part is 3.5 mm.

Preferably, the outer diameter of the sealing sheet is 1 to 2 mm smaller than the inner diameter of the positioning ring. It effectively seals the launch port while ensuring that the sealing piece can be punched open.

The beneficial effect of the application is that it can ensure the successful launch of the color bar; at the same time, it has the advantages of simple structure, convenient assembly and low cost.

In order to make the above objectives, features and advantages of the present application more obvious and easy to understand, the present application will be further described in detail below in conjunction with the accompanying drawings and specific embodiments.

In the following description, many specific details are explained in order to fully understand the present invention. However, the present application can be implemented in many other ways different from those described here. Those skilled in the art can make similar improvements without departing from the connotation of the present application. Therefore, the present application is not subject to the specific embodiments disclosed below limit.

It should be noted that when an element is referred to as being "fixed to" another element, it can be directly on the other element or a central element may also be present. When an element is considered to be "connected" to another element, it can be directly connected to the other element or an intermediate element may be present at the same time.

Unless otherwise defined, all technical and scientific terms used herein have the same meaning as commonly understood by those skilled in the technical field of the present application. The terminology used in the description of the present application herein is only for the purpose of describing specific embodiments, and is not intended to limit the present application. The term "and/or" as used herein includes any and all combinations of one or more related listed items.

DETAILED DESCRIPTION

Figure 1:
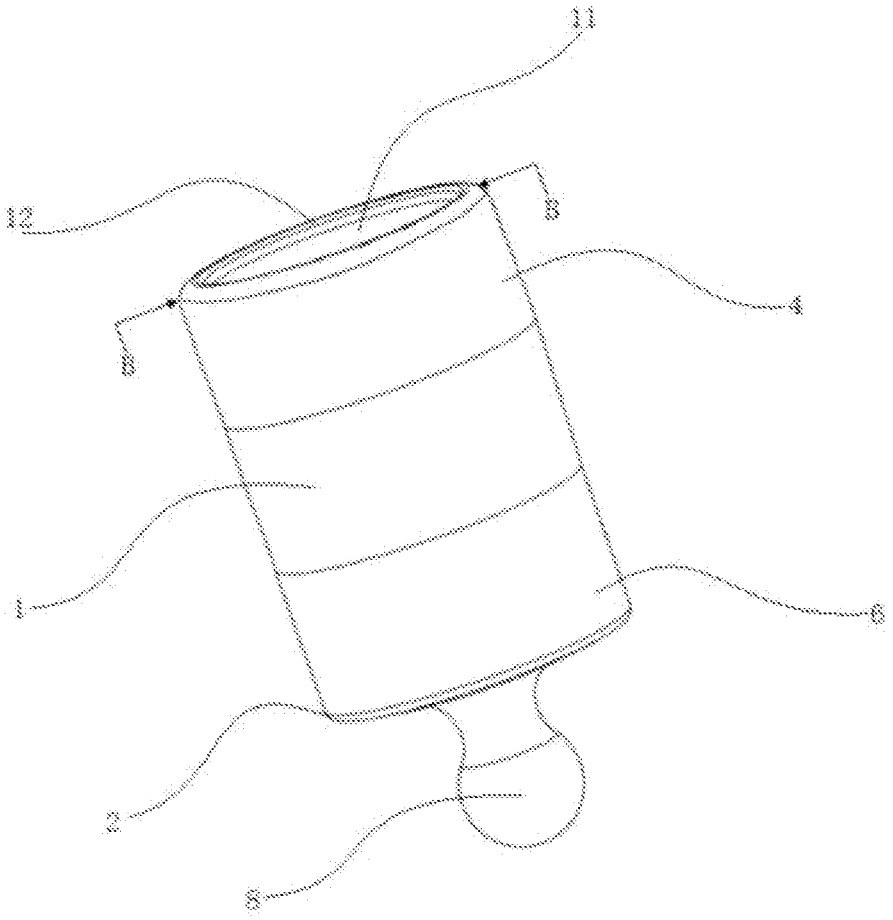
FIG. 1 is a schematic diagram of the overall appearance of an embodiment of the application.
Figure 2:
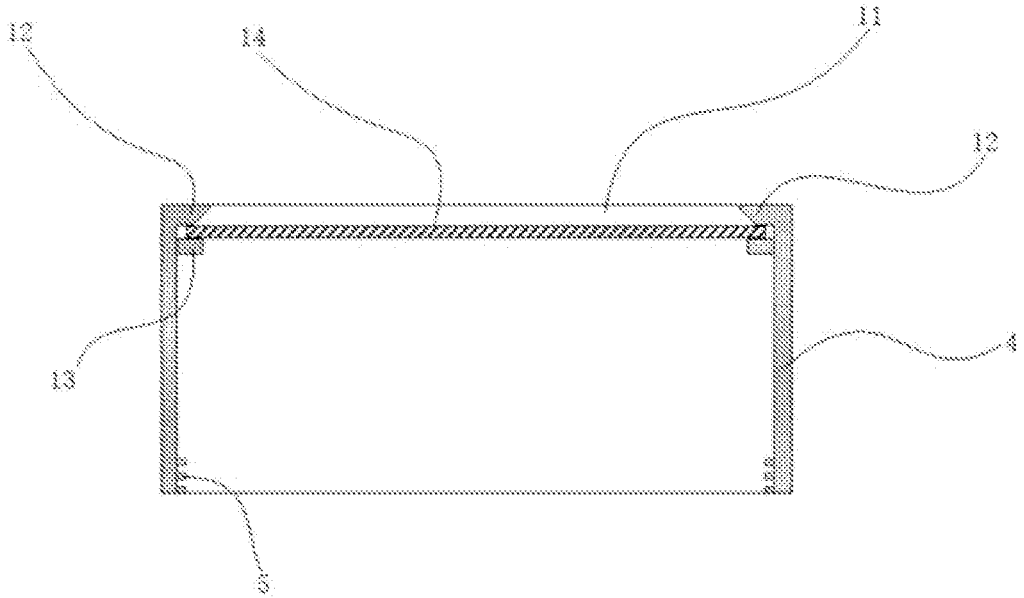
FIG. 2 is an enlarged view of the B-B cross-sectional structure of the end cap shown in FIG. 1.
Figure 3:
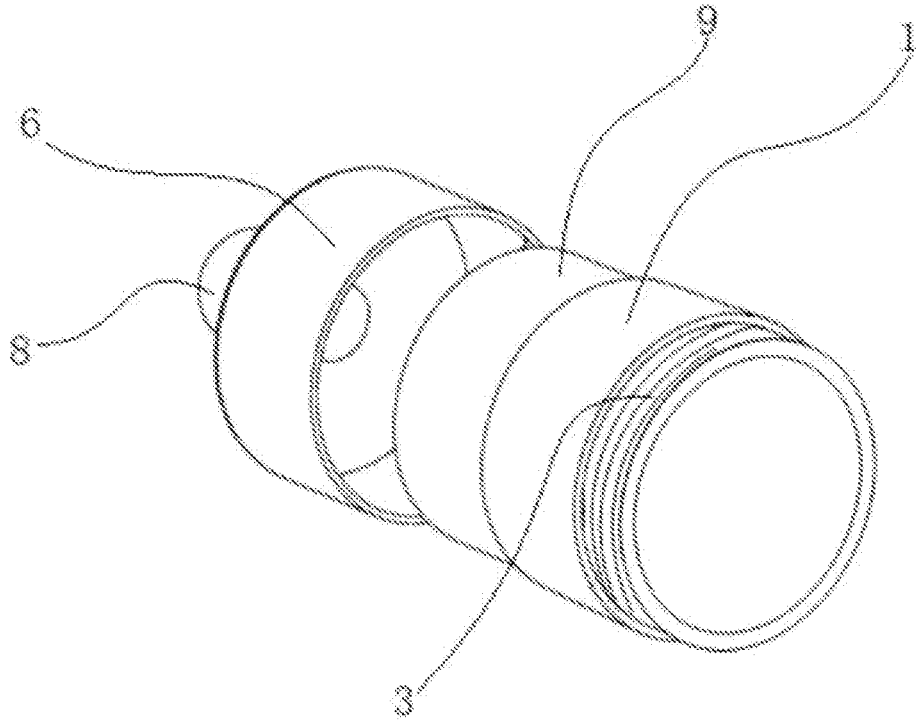
FIG. 3 is a schematic diagram of the split matching structure of the cylinder and the elastic sleeve.
Figure 4:
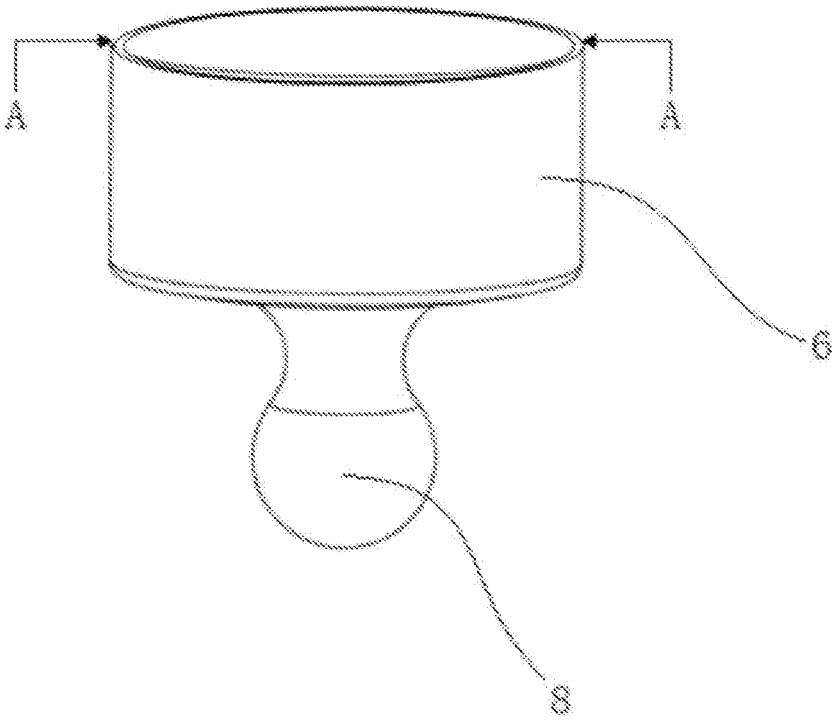
FIG. 4 is a schematic diagram of the structure of the elastic sleeve.

Refer to the drawings to reflect a specific structure of the present application. The color bar launcher includes a cylinder 1 containing color bars (not shown in the figure), an end cover 4, and an elastic sleeve 2. The two ports of the cylinder 1 are open, one end is connected to the internal thread 5 of the end cap 4 through the external thread 3, and the other end is closed by the elastic sleeve 2. The elastic sleeve 2 is composed of a similar elastic fabric such as rubber skin or plastic skin.

The middle part of the outer side of the elastic sleeve 2 is provided with a hand-pinching portion. In this example, the hand-pinching portion is a protrusion 8 on the body of the elastic sleeve 2.

the elastic sleeve 2 includes sleeve portion 6, cover portion 7 and protrusion portion 8. When assembling, the sleeve part 6 can be wrapped and glued on the recessed area 9 on the outer side wall of the cylinder 1, which is very convenient. The cover portion 7 closes the port of the cylinder 1, and the protrusion 8 is located in the middle position of the cover portion 7.

Figure 5:
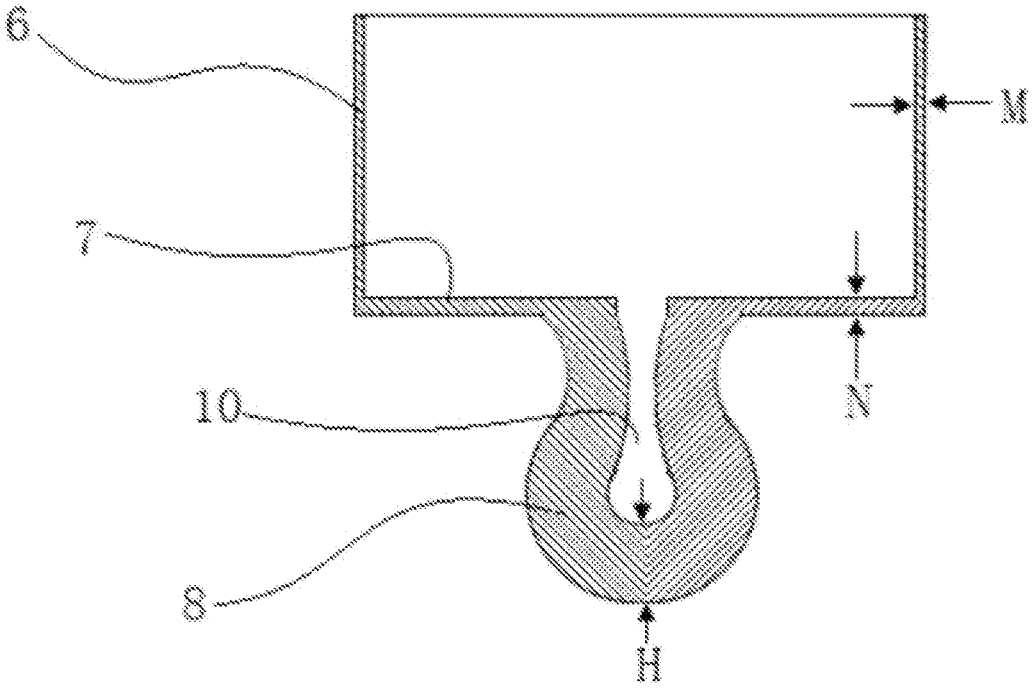
FIG. 5 is a cross-sectional structural view of A-A shown in FIG. 4.

In this example, the protrusion 8 is a hollow body, and the middle cavity 10 of the hollow body communicates with the inner cavity of the cylinder 1. In this example, as shown in FIG. 5, the thickness M of the sleeve portion 6 is 1.1 mm, the thickness N of the cover portion 7 is 1.8 mm, and the thickness H of the protrusion 8 is 3.5 mm.

The cover surface of the end cap 4 is provided with a launching port 11, a positioning ring 12 is fixed around the launching port 11, and four fixing bodies 13 are evenly distributed along the circumference of the inner side of the positioning ring 12. The sealing sheet 14 is fixed between the ring 12 and the fixing body 13. The sealing sheet is a hard paper sheet. The outer diameter of the sealing sheet 14 is smaller than the inner diameter of the positioning ring 12 by 1 to 2 millimeters. While effectively closing the launching port 11, it is ensured that the sealing sheet 14 can be punched out.

When in use, pinch the protrusion 8 with your hand to pull the cover 7 outward. The protrusion 8 has a cavity 10, which can be greatly elongated and deformed together with the cover 7 to absorb air and accumulate elastic potential energy; Release, the protrusion 8 and the cover 7 rebound, and the air in the cylinder 1 is driven to impact the sealing sheet 14. The sealing sheet 14 is slightly deformed and its edge is separated from the restraint of the positioning ring 12 and the card body 13, and is removed from the launch port 11. Punch out to release the closure of the launch port 11; at the same time, the inner side of the cover 7 also directly touches the color bar, and directly drives the color bar to eject when it rebounds, and the color bar is launched from the open launch port 11 with the assistance of the air in the cylinder. Into the air.

It can be seen from the above that the application can ensure the successful launch of the color bar; at the same time, it has the advantages of simple structure, convenient assembly and low cost.

The foregoing implementation manners are only to clearly illustrate the technical solutions of the present application, and should not be understood as making any restrictions on the present application. The application has a variety of well-known substitutions or modifications in the technical field, and all of them fall into the protection scope of the application without departing from the essential meaning of the application.

The invention claimed is:

1. A color bar launcher, comprising a cylinder body for holding color bars, and an elastic sleeve;

two ends of the cylinder body are open, one end is connected to an end cover, and the other end is closed by the elastic sleeve; a middle part of an outer side of the elastic sleeve is provided with a hand pinching part; a cover surface of the end cover is provided with a launching port, a positioning ring is fixed around the launching port, protrusions are arranged on an inner side of the positioning ring, and a sealing sheet which closes the launching port is movably assembled between the positioning ring and the protrusions.

2. The color bar launcher of claim 1, wherein the hand pinching part is a protrusion on the body of the elastic sleeve.

3. The color bar launcher of claim 2, wherein the elastic sleeve comprises an integrally formed sleeve part, a cover part and a protruding part; the sleeve part wraps the outer side wall of the cylinder body, the cover part closes the ends of the cylinder, and the protruding part is located in the middle position of the cover part.

4. The color bar launcher of claim 3, wherein the protruding part is a hollow body, and the middle cavity of the hollow body communicates with the inner cavity of the cylinder body.

5. The color bar launcher of claim 3, wherein the thicknesses of the sleeve part, cover part and the protrusion part increase in order.

6. The color bar launcher of claim 5, wherein the thickness of the sleeve part is 0.8-1.5 mm, the thickness of the cover part is 1.6-2.2 mm, and the thickness of the protrusion part is 2.5-4.5 mm.

7. The color bar launcher of claim 6, wherein the thickness of the sleeve part is 1.1 mm, the thickness of the cover part is 1.8 mm, and the thickness of the protrusion part is 3.5 mm.

8. The color bar launcher of claim 1, wherein the outer diameter of the sealing sheet is 1 to 2 mm smaller than the inner diameter of the positioning ring.

* * * * *